US012708860B2

(12) United States Patent
Sakai

(10) Patent No.: US 12,708,860 B2
(45) Date of Patent: Aug. 18, 2026

(54) STORAGE CASE FOR FUSIBLE TOY BEAD

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 138 days.

(21) Appl. No.: 18/413,923

(22) Filed: Jan. 16, 2024

(65) Prior Publication Data

US 2024/0238687 A1 Jul. 18, 2024

(30) Foreign Application Priority Data

Jan. 17, 2023 (JP) ..... 2023-005137

(51) Int. Cl.
*A63H 33/00* (2006.01)

(52) U.S. Cl.
CPC ..... *A63H 33/00* (2013.01)

(58) Field of Classification Search
CPC ..... A63H 33/26
See application file for complete search history.

(56) References Cited

U.S. PATENT DOCUMENTS 1,529,831 A * 3/1925 Brennan ..... G09F 7/06 29/10
3,869,824 A * 3/1975 Lemelson ..... A63H 33/22 446/87
4,731,913 A 3/1988 Plantureux et al.
4,986,756 A * 1/1991 Yamaguchi ..... A63F 9/06 434/96
5,218,839 A * 6/1993 Udko ..... A44C 17/02 63/26

(Continued)

FOREIGN PATENT DOCUMENTS

CN 201020287 Y 2/2008
CN 205323231 U 6/2016

(Continued)

OTHER PUBLICATIONS

Akira, machine translation of JP-201814331-A, uploaded Apr. 14, 2026, Espacenet, 4 pages.*

(Continued)

*Primary Examiner* — Michael D Dennis
*Assistant Examiner* — Matthew B Stanczak
(74) *Attorney, Agent, or Firm* — Faegre Drinker Biddle & Reath LLP

(57) ABSTRACT

A storage case for fusible toy bead includes: a main body portion; and a storage portion provided in the main body portion. The main body portion has a recess portion configured to allow one fusible toy bead to be fitted and held. The recess portion has: a first opening portion which is provided to be exposed to outside from the main body portion and which opens at a first opening diameter substantially equal to an outer diameter of the one fusible toy bead; and a second opening portion which is provided at a bottom portion of the recess portion and which opens at a second opening diameter smaller than the outer diameter of the one fusible toy bead. The recess portion has a dimension in a depth direction to store an entire part of the one fusible toy bead.

5 Claims, 6 Drawing Sheets

(56) References Cited

U.S. PATENT DOCUMENTS 5,377,506 A 1/1995 Tranzer
5,643,038 A * 7/1997 Olsen ..... A63H 33/04 446/128
5,704,789 A * 1/1998 Yang ..... G09B 11/00 434/96
5,761,780 A * 6/1998 Magi ..... A44C 17/02 63/26
6,032,393 A * 3/2000 Maxim ..... G09F 9/37 434/96
6,067,818 A * 5/2000 Winkler ..... A44C 17/02 63/26
6,125,516 A * 10/2000 Winkler ..... A44C 17/04 63/26
6,668,584 B1 * 12/2003 Tosti ..... A44C 17/04 63/26
6,691,533 B2 * 2/2004 Feuer ..... A44C 17/0208 63/26
7,214,118 B1 * 5/2007 Maxim ..... A63H 33/22 362/249.14
7,390,237 B2 * 6/2008 Lin ..... A63F 9/1044 273/287
7,546,749 B1 * 6/2009 Biren ..... A44C 17/046 63/3
7,707,722 B1 5/2010 Kothari
8,584,329 B2 * 11/2013 Dhakka ..... A44C 17/046 63/26
8,827,711 B2 * 9/2014 Davis, II ..... B65D 1/34 434/96
8,857,059 B2 * 10/2014 Bizzotto ..... A44C 17/046 63/38
8,870,185 B2 * 10/2014 Cheng ..... A63F 3/00003 273/281
9,532,633 B1 1/2017 Tan et al.
9,849,718 B1 * 12/2017 Garrett ..... A44C 27/00
9,956,495 B2 * 5/2018 Kamiyama ..... A63F 9/06
10,279,278 B2 * 5/2019 Sakai ..... A63F 9/06
10,478,740 B2 * 11/2019 Sakai ..... A63H 33/001
D891,513 S * 7/2020 Sakai ..... D19/111
D891,514 S * 7/2020 Sakai ..... D19/111
D891,515 S * 7/2020 Sakai ..... D19/111
D891,516 S * 7/2020 Sakai ..... D19/111
D893,748 S * 8/2020 Yetkinler ..... D11/184
10,758,813 B2 * 9/2020 Sakai ..... A63H 33/06
D901,907 S * 11/2020 Sakai ..... D6/303
D923,090 S * 6/2021 Sakai ..... D19/111
11,064,777 B2 * 7/2021 Uldry ..... A44C 17/02
11,117,066 B2 * 9/2021 Sakai ..... A63H 33/001
D986,323 S 5/2023 Sakai
D987,721 S * 5/2023 Sakai ..... D19/111
11,648,459 B2 * 5/2023 Sakai ..... A63H 33/06 446/85
D988,174 S * 6/2023 Shah ..... D11/2
D988,402 S * 6/2023 Sakai ..... D19/111
D1,016,912 S * 3/2024 Sakai ..... D19/111
11,964,216 B2 * 4/2024 Feng ..... A63H 33/086
12,251,644 B2 * 3/2025 Sakai ..... A63H 33/10
12,311,282 B2 * 5/2025 Robbins ..... A63H 33/14
2002/0102905 A1 * 8/2002 Tseng ..... A63H 33/046 446/131
2008/0011770 A1 * 1/2008 Tobias ..... B44B 9/00 221/189
2008/0149252 A1 * 6/2008 Welker ..... B44C 1/28 156/265
2009/0107021 A1 4/2009 Koeppel
2009/0173747 A1 * 7/2009 Reynolds ..... A63H 33/00 221/92
2012/0186748 A1 * 7/2012 Kamiyama ..... A63H 9/00 156/349
2013/0183881 A1 * 7/2013 Kamiyama ..... B44C 3/12 446/87
2013/0236679 A1 * 9/2013 Bizzotto ..... B23P 11/00 29/428
2014/0120501 A1 * 5/2014 Cooke ..... B44C 3/123 434/81
2016/0271510 A1 * 9/2016 Ho ..... A63H 33/14
2016/0354705 A1 * 12/2016 Poulus ..... A63H 33/04
2017/0087480 A1 * 3/2017 Poulus ..... A63H 33/086
2017/0246551 A1 * 8/2017 Kamiyama ..... A63H 33/001
2017/0291115 A1 * 10/2017 Sakai ..... A63F 9/06
2018/0036647 A1 * 2/2018 Sakai ..... A63H 33/04
2018/0043276 A1 * 2/2018 Sakai ..... A63H 33/14
2018/0333653 A1 * 11/2018 Sakai ..... A63H 33/06
2019/0192961 A1 * 6/2019 Sakai ..... B44B 9/00
2019/0329144 A1 * 10/2019 Sakai ..... B44C 3/12
2019/0336880 A1 * 11/2019 Sakai ..... A63H 33/00
2019/0358549 A1 11/2019 Osipov et al.
2020/0161037 A1 5/2020 Osipov
2020/0388421 A1 12/2020 Osipov
2021/0125763 A1 4/2021 Osipov
2021/0252413 A1 8/2021 Osipov et al.
2023/0218982 A1 * 7/2023 Sakai ..... B44C 3/12 446/87
2024/0238687 A1 * 7/2024 Sakai ..... A63H 33/00
2024/0238690 A1 * 7/2024 Sakai ..... A63H 33/086
2024/0367068 A1 * 11/2024 Sakai ..... A63H 33/001
2024/0367070 A1 * 11/2024 Sakai ..... A63H 33/06
2024/0408507 A1 * 12/2024 Thijs ..... A63H 33/065
2025/0144540 A1 * 5/2025 Sakai ..... A63H 33/14
2025/0353321 A1 * 11/2025 Monzo ..... B44D 3/22

FOREIGN PATENT DOCUMENTS

CN 206108019 U 4/2017
CN 208081864 U 11/2018
CN 109789334 A 5/2019
CN 115043098 A 9/2022
CN 222248197 U 12/2024
ES 2978171 A2 9/2024
JP 3095833 U 8/2003
JP 2018143331 A * 9/2018
JP 2022-185209 A 12/2022
KR 2016-0095868 A 8/2016

OTHER PUBLICATIONS

Spanish State of the Art Report issued Dec. 19, 2024 in Application No. P202430034.
British Search Report issued Jun. 20, 2024 in Application No. GB2400608.2.
Spanish Office Action issued Apr. 28, 2025 in Application No. 202430034.
First Chinese Office Action issued Aug. 1, 2025, in Application No. 202410068761.4.
Second Chinese Office Action issued Jan. 7, 2026 in Application No. 202410068761.4.

* cited by examiner

STORAGE CASE FOR FUSIBLE TOY BEAD

CROSS-REFERENCE TO RELATED APPLICATIONS

This application is based on and claims priority under 35 USC 119 from Japanese Patent Application No. 2023-005137 filed on Jan. 17, 2023, the contents of which are incorporated herein by reference.

TECHNICAL FIELD

The present disclosure relates to a storage case for fusible toy bead.

BACKGROUND ART

In the related art, there is known a storage case that can store and carry a large number of beads. For example, JP3095833U discloses a bead storage container that is convenient to carry and easy to handle. The bead storage container includes a flat main body and a lid body connected via a hinge, and a plurality of hemispherical concave surfaces in which beads are stored are provided inside the main body. When the lid body is closed, a hook piece of the lid body is engaged with a receiving piece of the main body, and the inside is sealed.

SUMMARY OF INVENTION

In recent years, a fusible toy bead is gaining popularity in which beads can be fused together simply by spraying water to create a bound body of beads in various forms. Such a fusible toy bead can also be stored in the storage case in the related art. However, the storage case in the related art is only used to store the beads, and does not allow enjoyment using the beads.

An object of the present disclosure is to provide a storage case for fusible toy bead that not only stores beads but also allows enjoyment using the beads.

In one aspect of the present disclosure, there is provided a storage case for fusible toy bead, includes: a main body portion; and a storage portion provided in the main body portion and configured to store a plurality of fusible toy beads, in which the main body portion has at least one recess portion configured to allow one fusible toy bead to be fitted and held, in which the at least one recess portion has: a first opening portion which is provided to be exposed to outside from the main body portion and which opens at a first opening diameter substantially equal to an outer diameter of the one fusible toy bead; and a second opening portion which is provided at a bottom portion of the at least one recess portion and which opens at a second opening diameter smaller than the outer diameter of the one fusible toy bead, and in which the at least one recess portion has a dimension in a depth direction to store an entire part of the one fusible toy bead.

According to an aspect of the present disclosure, it is possible to provide a storage case for fusible toy bead that not only stores beads but also allows enjoyment using the beads.

BRIEF DESCRIPTION OF DRAWINGS

The present disclosure will be described in detail based on the following without being limited thereto, wherein:

FIGS. 4A and 4B are enlarged front views of the vicinity of a fastener portion of the storage case, in which FIG. 4A shows a state in which no fusible toy bead is fitted into mounting holes, and FIG. 4B shows a state in which fusible toy beads are fitted into the mounting holes;

FIGS. 5A and 5B is are longitudinal sectional views of the vicinity of the fastener portion of the storage case, in which FIG. 5A is a sectional view taken along a line Va-Va in FIG. 4A, and FIG. 5B is a sectional view taken along a line Vb-Vb in FIG. 4B.

DESCRIPTION OF EMBODIMENTS

Figure 1:
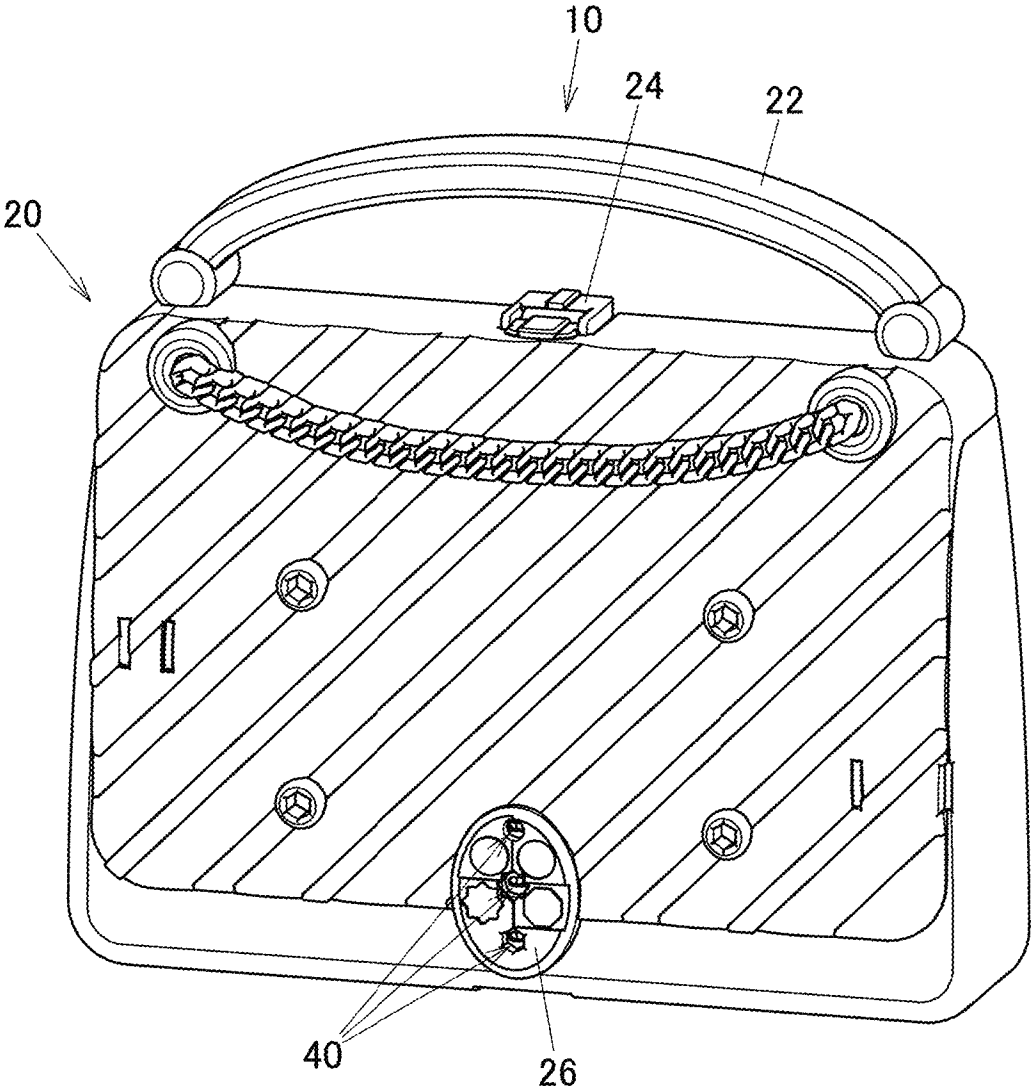
FIG. 1 is a perspective view of a storage case according to an embodiment of the present disclosure as viewed from a front side.
Figure 2:
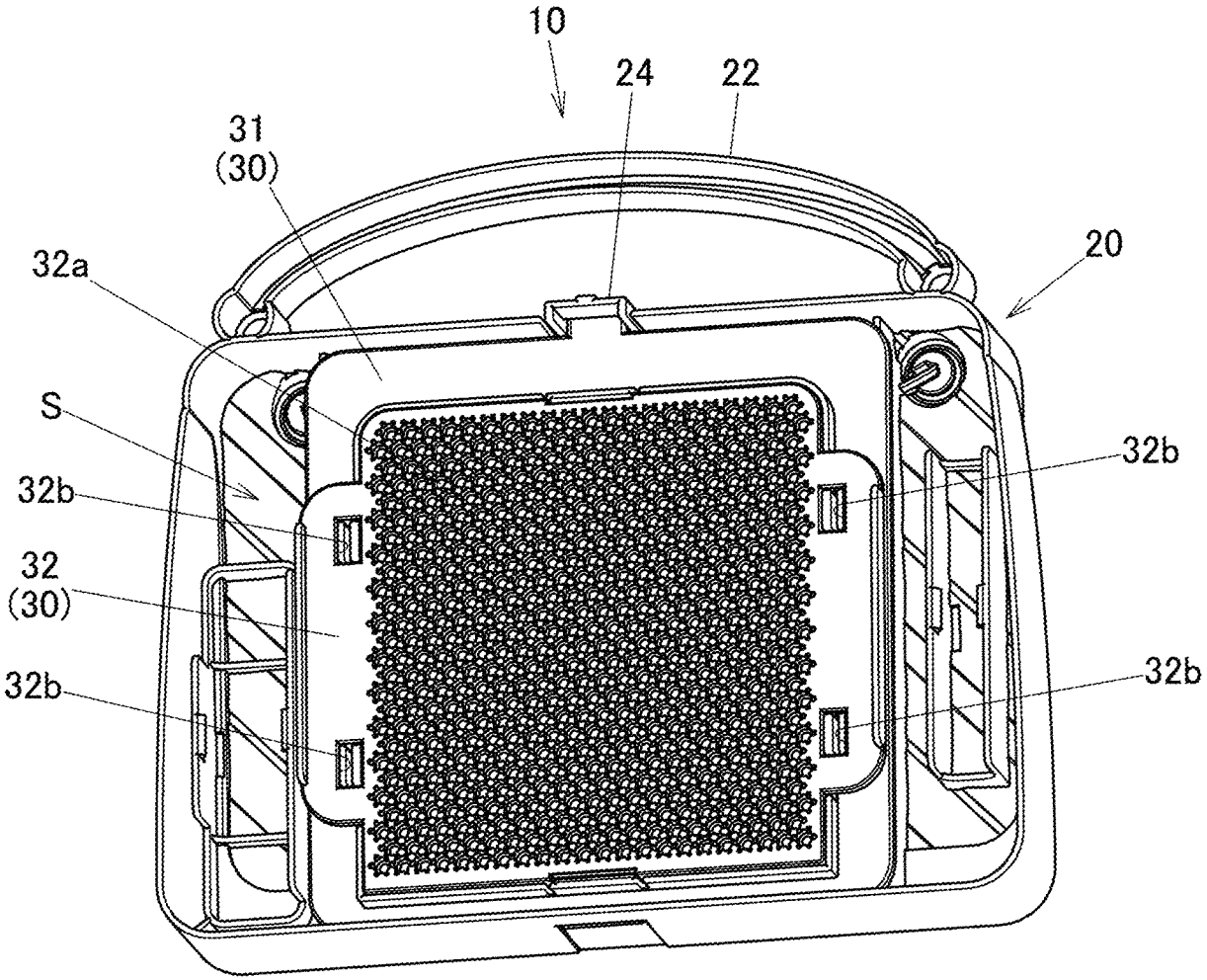
FIG. 2 is a perspective view of the storage case according to the embodiment of the present disclosure as viewed from a rear side.

An embodiment of the present disclosure will be described with reference to the drawings. As shown in FIG. 1, in the present embodiment, a storage case for fusible toy bead (hereinafter referred to as "storage case 10") for storing fusible toy beads B (see FIG. 4B and the like) is exemplified. As shown in FIGS. 1 and 2, the storage case 10 includes a main body portion 20 that has a shape imitating a handbag, and a creation tray 30 can be attached to and detached from the main body portion 20. The creation tray 30 is a tray that is played by arranging the plurality of fusible toy beads B in accordance with various patterns or the like and combining the fusible toy beads B to each other by spraying water with a sprayer or the like. As shown in FIG. 2, one side of the main body portion 20 is open so that the creation tray 30 can be seen.

The main body portion 20 includes a handle portion 22 having a shape imitating a handle of a handbag, a lock portion 24 having a shape imitating a lock part, and a fastener portion 26 having a shape imitating a fastener part. Hereinafter, description will be made assuming that a side of the main body portion 20 on which the handle portion 22 is provided is referred to as an upper side of the storage case 10, a side opposite thereto is referred to as a lower side, a side of the main body portion 20 on which the fastener portion 26 is provided is referred to as a front side of the storage case 10, a side opposite thereto, which is an open side, is referred to as a rear side, a right side when the main body portion 20 is viewed from the front side is referred to as a right side of the storage case 10, and a side opposite thereto is referred to as a left side.

First, the creation tray 30 will be described. As shown in FIG. 2, a storage space S to which the creation tray 30 is attached and stored is provided in the main body portion 20. The creation tray 30 includes a first tray 31 having a substantially square plate shape, and a second tray 32 having a substantially square plate shape that is stacked on the rear side of the first tray 31 and slightly smaller than the first tray 31. A dimension in an upper-lower direction of the first tray 31 is substantially equal to a dimension in the upper-lower direction in the storage space S. First engagement holes 20*a* to which the first tray 31 is engaged are respectively provided at upper and lower end portions of a central portion in a left-right direction in the storage space S of the main body portion 20 (see FIG. 3). The first tray 31 is attached to the main body portion 20 by engagement with the first engagement holes 20*a* on both upper and lower end sides respectively.

The second tray 32 has a holding hole group 32*a* into which the plurality of fusible toy beads B are fitted and held. The holding hole group 32*a* is provided with an opening side facing the rear side. By fitting a plurality of fusible toy beads B into the holding hole group 32*a* and spraying water, adjacent fusible toy beads B are fused and combined to each other so as to create an aggregate of fusible toy beads B. Second engagement holes 32*b*, into which the first tray 31 is engaged, are provided on both left and right sides of the second tray 32. The second tray 32 is attached to the first tray 31 while being stored in the storage space S by the engagement of the second engagement holes 32*b* with the first tray 31. The storage case 10 can be easily carried by gripping the handle portion 22 with the second tray 32 removed.

Figure 3:
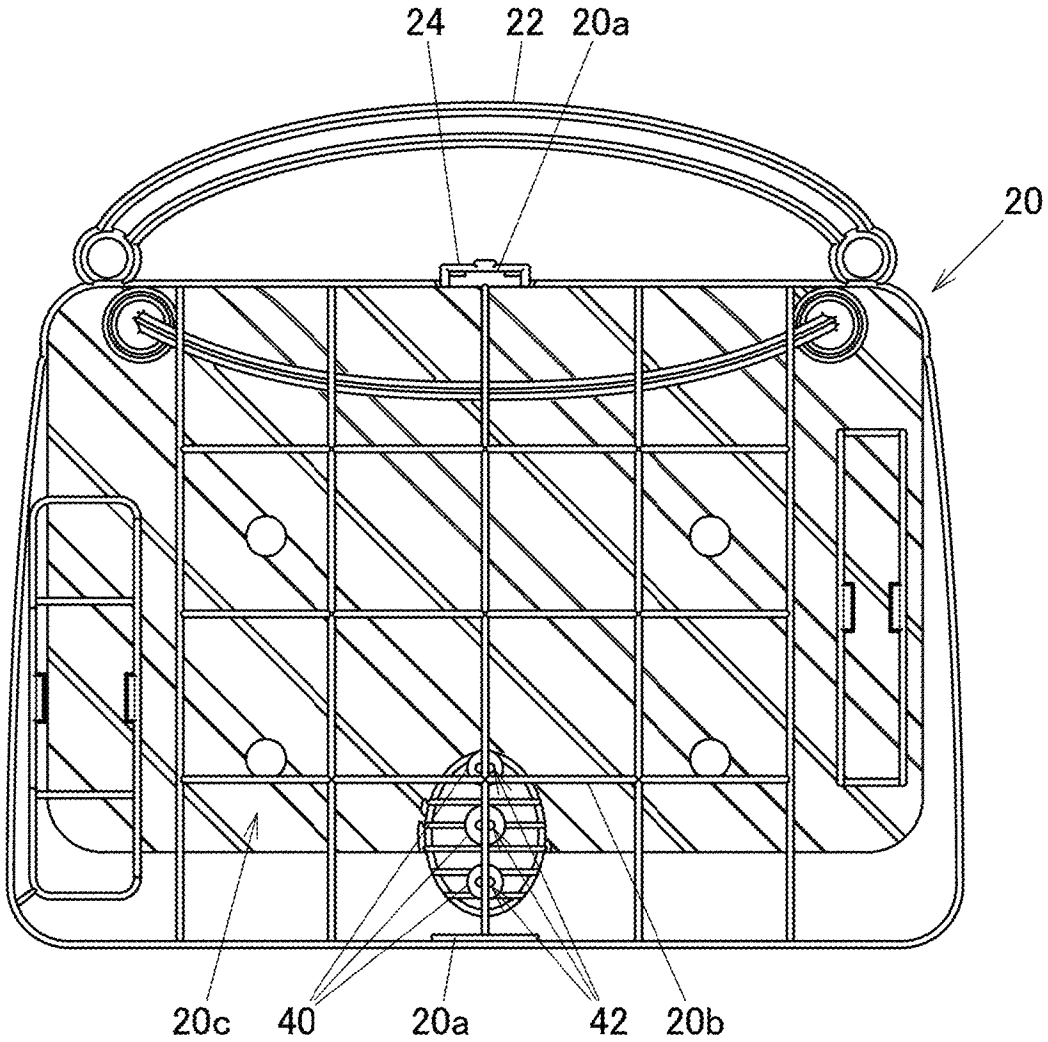
FIG. 3 is a rear view of a main body portion with a creation tray removed from the rear side.

As shown in FIG. 3, reinforcing ribs 20*b* forming a lattice shape are provided in the storage space S. The first tray 31 is attached to the main body portion 20 in a state where a front surface thereof is in contact with the reinforcing ribs (rib-shaped member) 20*b*. Therefore, when carrying the storage case 10, the first tray 31 is prevented from shaking. A storage portion 20*c* in which a plurality of fusible toy beads B are stored is provided between the reinforcing ribs 20*b*. By attaching the first tray 31 to the main body portion 20 in a state in which the plurality of fusible toy beads B are stored in the storage portion 20*c*, the first tray 31 serves as a lid to close the storage portion 20*c*, and the fusible toy beads B are prevented from spilling out from the storage portion 20*c*.

Figure 4A:
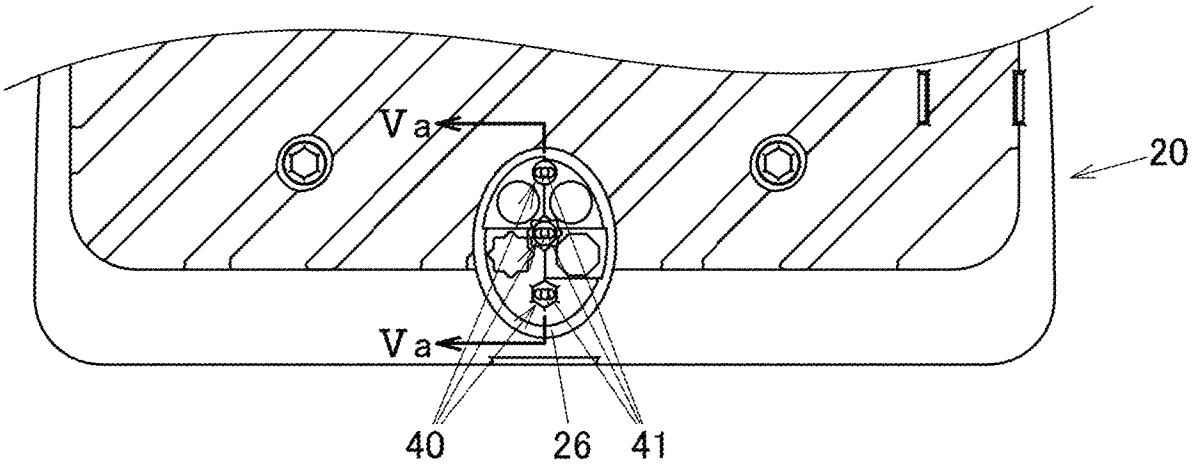
Figure 4B:
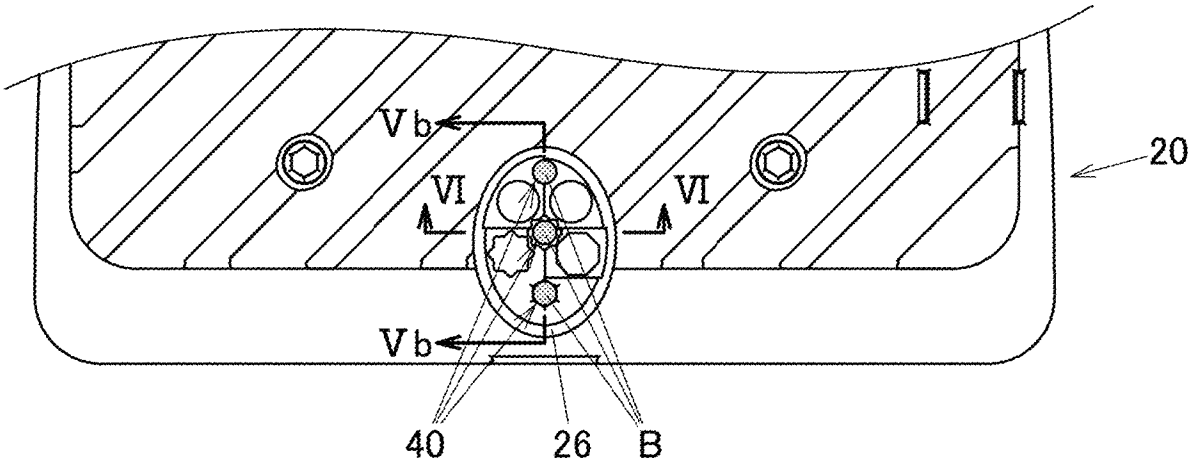
Figure 5A:
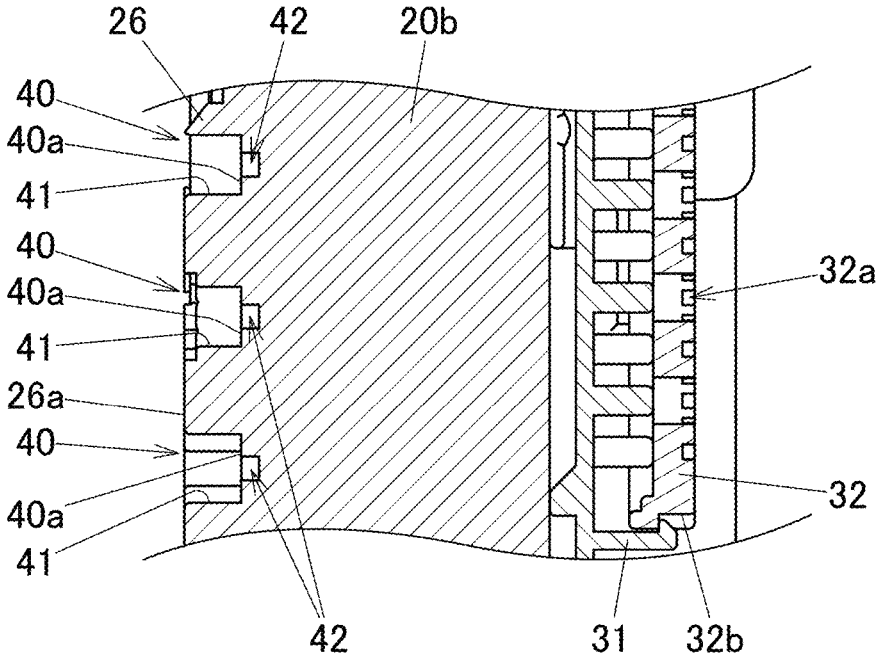

Next, mounting holes 40 provided in the main body portion 20, which are an essential part of the present disclosure, will be described. As shown in FIG. 4A, the fastener portion 26 positioned on the lower side of a front surface of the main body portion 20 is provided in a vertically long elliptical conical shape so as to protrude toward the front side from the front surface of the main body portion 20. The fastener portion 26 is provided with three recessed mounting holes (recess portions) 40 in which the fusible toy beads B are fitted and held (mounted) at approximately equal intervals in the upper-lower direction. As shown in FIGS. 4A and 5A, each mounting hole 40 is a through hole that penetrates in the front-rear direction, and has a first opening portion 41 that opens to the front side, and a second opening portion 42 that is provided in a bottom portion 40*a* of the mounting hole 40 and opens to the rear side with an opening diameter smaller than that of the first opening portion 41 (see FIG. 6).

Figure 5B:
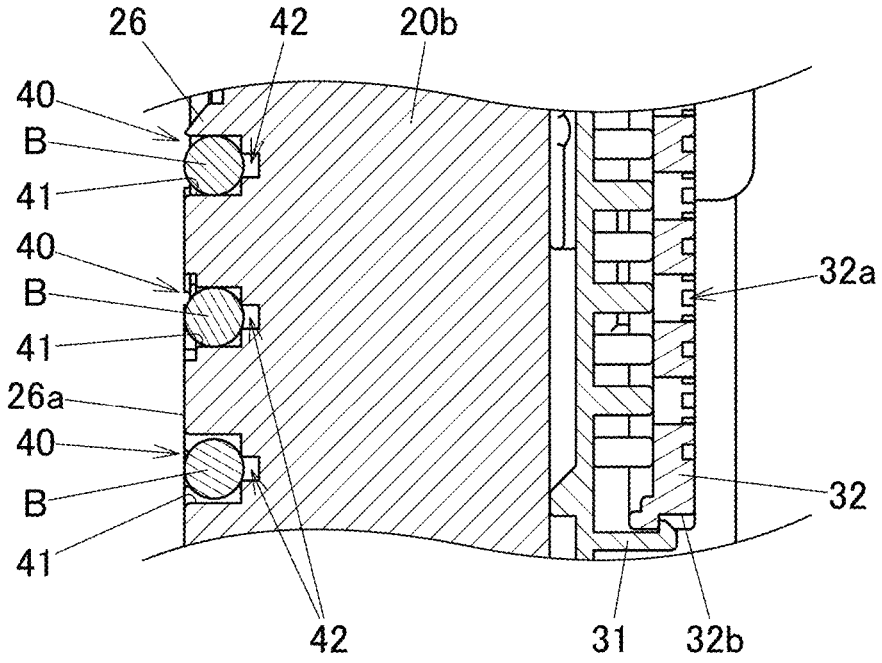
Figure 6:
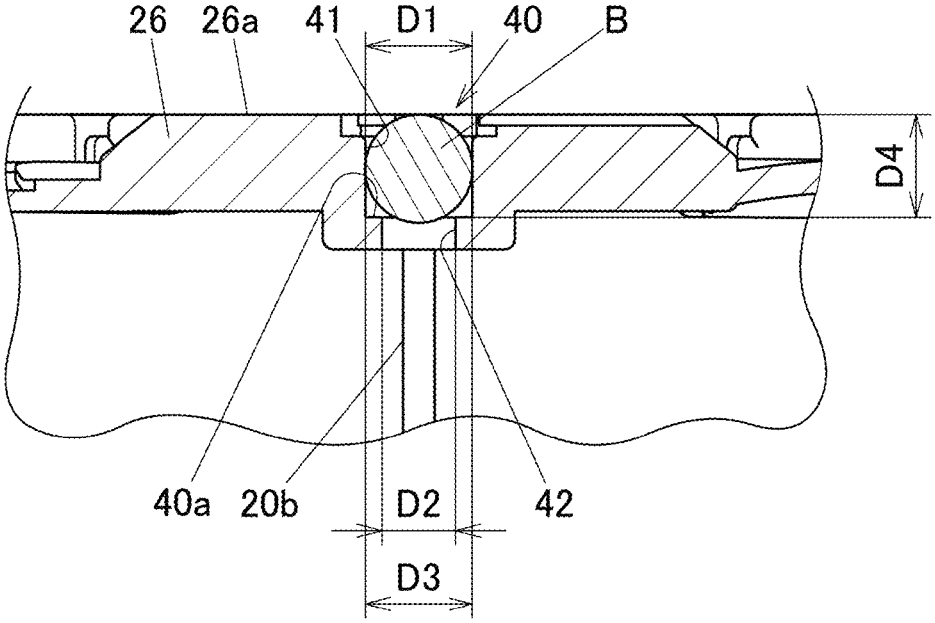
FIG. 6 is a longitudinal sectional view of the vicinity of the fastener portion of the storage case, and is a sectional view taken along a line VI-VI in FIG. 4B.

As shown in FIG. 6, the first opening portion 41 is exposed to the outside from the fastener portion 26 of the main body portion 20, and an opening diameter D1 (a first opening diameter) thereof is made equal to an outer diameter D3 of the fusible toy bead B. Therefore, an outer surface of the fusible toy bead B fitted into each mounting hole 40 is in contact with an inner surface of the mounting hole 40, and is held in the mounting hole 40 by a frictional force between the fusible toy bead B and an inner surface of the mounting hole 40 (see FIGS. 4B and 5B). The term "equal" used for comparing the opening diameter D1 with the outer diameter D3 may include "approximately equal". For example, as long as the mounting hole 40 can hold the fusible toy bead B, the opening diameter D1 may be exactly equal to the outer diameter D3, or may be slightly larger than the outer diameter D3, or may be slightly smaller than the outer diameter D3. Of the three mounting holes 40, the first opening portions 41 of the two upper mounting holes 40 have a circular opening shape, and the first opening portion 41 of the mounting hole 40 positioned on the lowermost side has a regular hexagonal opening shape. Further, an opening diameter D2 (a second diameter) of the second opening portion 42 is smaller than the outer diameter D3 of the fusible toy bead B, and an opening shape is a horizontally elongated elliptical shape or a long hole shape. The term "an elliptical shape" may include "a substantially elliptical shape", and the term "long hole shape" may include "a substantially long hole shape". For example, as long as the opening of the second opening portion 42 is not excessively narrowed even when the reinforcing ribs 20*b* or the like is provided on the rear side of the second opening portion 42, the opening shape of the second opening portion 42 may be a precise elliptical shape or a precise long hole shape, or may be a shape slightly different from the precise elliptical shape or the precise long hole shape.

As shown in FIG. 6, each of the mounting holes 40 has a dimension D4 in a depth direction such that one fusible toy bead B can be entirely stored therein. Since the fusible toy bead B is entirely stored within the mounting hole 40, the fusible toy bead B does not protrude from the mounting hole 40, and the outer surface on the front side thereof has the same height as an opening surface of the first opening portion 41 (a front surface 26*a* of the fastener portion 26). Since the opening diameter of the second opening portion 42 is smaller than the outer diameter D3 of the fusible toy bead B, the fusible toy bead B stored in the mounting hole 40 does not pass through the mounting hole 40 and fall out to the rear side of the mounting hole 40. In the present embodiment, the outer diameter D3 of the fusible toy bead B is, for example, approximately 5.0 mm. Further, in the present embodiment, the opening diameter D1 of the first opening portion 41 and the opening diameter D2 of the second opening portion 42 are, for example, in the range of approximately 4.8 mm to approximately 5.0 mm, but the opening diameter D2 of the second opening portion 42 is smaller than the outer diameter D3 of the fusible toy bead B as described above. Further, in the present embodiment, the dimension D4 in the depth direction is, for example, approximately 5.0 mm or greater.

As shown in FIG. 3, on the rear side of each mounting hole 40, the above-described reinforcing rib 20*b* is provided so as to be in contact with an opening edge of each second opening portion 42 from the rear side. The reinforcing rib 20*b* extends in the upper-lower direction from a central portion in the left-right direction of the opening of each second opening portion 42, so that each second opening portion 42 is divided into two left and right openings by the reinforcing rib 20*b*. The fusible toy bead B held in the mounting hole 40 can be easily removed from the mounting hole 40 by being pushed forward from the rear side of each mounting hole 40 to the opening of the second opening portion 42 with a thin pin or the like. When the fusible toy bead B in a wet state is fitted into the mounting hole 40, water attached to the fusible toy bead B is discharged to the rear side of the storage case 10 through the second opening portion 42, so that the water is prevented from accumulating in the mounting hole 40.

As described above, in the storage case 10 according to the embodiment of the present disclosure, while the plurality of fusible toy beads B are stored in the storage portion 20*c*, the fusible toy beads B are fitted and held in the respective mounting holes 40 of the main body portion 20, so that the decorativeness of the storage case 10 can be enhanced. At this time, the fusible toy beads B do not protrude from the mounting holes 40, so that even if the storage case 10 falls forward, the fusible toy beads B fitted into the mounting holes 40 are not damaged by colliding with the ground or the like. Furthermore, in the present embodiment, the opening shape of the two upper first opening portions 41 and the opening shape of the first opening portion 41 on the lowermost side are different, so that it can be visually enjoyed.

Further, by pushing the fusible toy bead B forward from the rear side of the mounting hole 40 through the opening of the second opening portion 42, the fusible toy bead B can be easily removed from the mounting hole 40. As described above, the storage case 10 according to the embodiment of the present disclosure not only stores the fusible toy bead B, but also allows the fusible toy bead B to be used and enjoyed.

According to the embodiment of the present disclosure described above, it is possible to provide a storage case for fusible toy bead of the following aspects.

According to a first aspect of the present disclosure, a storage case for fusible toy bead includes a main body portion; and a storage portion provided in the main body portion and configured to store a plurality of fusible toy beads, in which the main body portion has at least one recess portion configured to allow one fusible toy bead to be fitted and held. The recess portion has: a first opening portion which is provided to be exposed to outside from the main body portion and which opens at a first opening diameter substantially equal to an outer diameter of the one fusible toy bead; and a second opening portion which is provided at a bottom portion of the at least one recess portion and which opens at a second opening diameter smaller than the outer diameter of the one fusible toy bead. The at least one recess portion has a dimension in a depth direction to store an entire part of the one fusible toy bead.

According to this configuration, an outer surface of the fusible toy bead fitted into the recess portion is in contact with an inner surface of the recess portion, so that the fusible toy bead can be fitted and held in the recess portion. By fitting and holding one fusible toy bead in the recess portion while storing a plurality of fusible toy beads in the storage portion, the fusible toy bead can be visually recognized from the first opening portion exposed to the outside from the main body portion, so that the decorativeness of the storage case for fusible toy bead can be enhanced. Further, the fusible toy bead fits entirely within the recess portion, even if the storage case for fusible toy bead falls toward the first opening portion, the fusible toy bead fitted into the recess portion is not damaged by colliding with the ground or the like. Further, by pushing out the fusible toy bead from the second opening portion, the fusible toy bead can be easily taken out from the recess portion. Thus, the storage case for fusible toy bead not only stores the fusible toy bead, but also allows the fusible toy bead to be used and enjoyed.

In the storage case for fusible toy bead according to a second aspect, the second opening portion has a substantially elliptical shape or a long hole shape.

According to this configuration, even when a reinforcing rib or the like is provided on the rear side of the second opening portion, the opening of the second opening portion is not excessively narrowed, and the fusible toy bead can be pushed out from the recess portion through the second opening portion.

The storage case for fusible toy bead according to a third aspect further includes a rib-shaped member that contacts or disposed in a vicinity of an opening edge of the second opening portion. In the storage case for fusible toy bead according to a fourth aspect, the rib-shaped member is provided to define a lattice shape.

According to this configuration, the lattice-shaped member such as the rib-shaped member is provided so as not to interfere with the opening of the second opening portion, so that the opening edge of the second opening portion and/or the periphery of the recess portion including the second opening portion can be reinforced by the rib-shaped member while allowing the fusible toy bead in the recess portion to be pushed out through the second opening portion.

In the storage case for fusible toy bead according to a fifth aspect, the at least one recess portion has a plurality of recess portions, and the first opening portion of at least one of the plurality of recess portions has an opening shape different from that of another of the plurality of recess portions.

According to this configuration, by fitting and holding fusible toy beads in the plurality of recess portions, respectively, the decorativeness of the storage case for fusible toy bead can be further enhanced and the enjoyment can be further improved using the fusible toy beads.

Although the embodiment of the present disclosure have been described above, the present disclosure is not limited to the above embodiment, and various modifications can be made without departing from the gist thereof. For example, in the above-described embodiment, the configuration in which the three mounting holes are provided in the fastener portion along the upper-lower direction is exemplified, but there are no limitations on the number of mounting holes provided in the main body portion, a manner in which the mounting holes are arranged, a shape of the first opening portion, and the like. In the above-described embodiment, the fusible toy bead B is illustrated as having a spherical shape, but the fusible toy bead B may have various shapes other than the spherical shape, such as a polyhedron.

What is claimed is:

1. A storage case for fusible toy bead, comprising:

a main body portion;

a storage portion provided in the main body portion and configured to store a plurality of fusible toy beads; and a rib-shaped member, wherein the main body portion has at least one recess portion configured to allow one fusible toy bead to be fitted and held, wherein the at least one recess portion has:

a first opening portion which is provided to be exposed to outside from the main body portion and which opens at a first opening diameter substantially equal to an outer diameter of the one fusible toy bead; and a second opening portion which is provided at a bottom portion of the at least one recess portion and which opens at a second opening diameter smaller than the outer diameter of the one fusible toy bead, and wherein the at least one recess portion has a dimension in a depth direction to entirely store the one fusible toy bead, wherein the rib-shaped member is provided so as to be in contact with an opening edge of the second opening portion from a rear side of the at least one recess portion, and the rib-shaped member extends in an upper-lower direction from a central portion in a left-right direction of an opening of the second opening portion so that the second opening portion is divided into a left opening and a right opening by the rib-shaped member.

2. The storage case for fusible toy bead according to claim 1, wherein the second opening portion has an elliptical shape or a long hole shape.

3. The storage case for fusible toy bead according to claim 1, wherein the rib-shaped member is provided to define a lattice shape.

4. The storage case for fusible toy bead according to claim 1, wherein the at least one recess portion has a plurality of recess portions, and wherein the first opening portion of at least one of the plurality of recess portions has an opening shape different from that of another of the plurality of recess portions.

5. The storage case for fusible toy bead according to claim 1, wherein the one fusible toy bead is configured to not protrude from the at least one recess portion.

* * * * *